United States Patent [19]

Hotta

[11] 4,372,608

[45] Feb. 8, 1983

[54] TREATMENT CHAIR

[75] Inventor: Mitsuhiko Hotta, Kyoto, Japan

[73] Assignee: Kabushiki Kaisha Morita Seisakusho, Kyoto, Japan

[21] Appl. No.: 213,006

[22] Filed: Dec. 4, 1980

[30] Foreign Application Priority Data

Dec. 6, 1979 [JP] Japan ..... 54-169583[U]

[51] Int. Cl.[3] ..... A47C 1/024

[52] U.S. Cl. ..... 297/361; 297/355

[58] Field of Search ..... 297/361, 362, 358, 354, 297/355

[56] References Cited

U.S. PATENT DOCUMENTS 3,055,706 9/1962 Van Der Meer et al. ..... 297/358
3,284,135 11/1966 Hiramatsu ..... 297/361
3,902,755 9/1975 Sirot ..... 297/354 X
3,938,858 2/1976 Drabert et al. ..... 297/355 X
3,948,560 4/1976 Obermeier et al. ..... 297/355

*Primary Examiner*—William E. Lyddane
*Attorney, Agent, or Firm*—Koda and Androlia

[57] ABSTRACT

Improvements in a treatment chair whose backrest frame is designed to be tiltable with respect to the seat frame of the chair by use of a roller rotating within a guide groove are disclosed. In the disclosed embodiments all utilize an arc segment portion groove. As a result, the top portion of the backrest frame holds substantially the same peripheral speed throughout travels with raising and lowering of the backrest frame and the patient resting against the backrest frame is thereby free from any uncomfortable feeling due to preceptible changes in peripheral speed during the rise and fall movement of the frame.

4 Claims, 6 Drawing Figures

TREATMENT CHAIR

BACKGROUND OF THE INVENTION

1. Field of the Invention

This invention relates to a treatment chair whose backrest is designed to be raised and lowered at will with respect to a seat of the chair and which is suitable for use as a treatment chair for dental, medical treatment or the like purposes or for use as a barber's chair, and more particularly to improvements in the prior art treatment chair disclosed in Japanese Utility Model Publication No. 623/1965 (U.S. Pat. No. 3,284,135, DAS No. 1248860).

2. Prior Art

Referring to the characteristic features of said prior art treatment chair P with reference to FIG. 1 showing a side view of the chair P wherein, for convenience sake, the same reference characters are used as for the corresponding members of the present invention, when a lower end of a backrest frame 2 was drawn by a driving mechanism 6 in the direction of a seat fram 1, the backrest fram 2 was tilted with respect to the seat frame 1 and, simultaneously therewith, the lower end of the frame 2 dipped in an arcuate movement, and accordingly the head and back regions of a patient were prevented from sliding along the backrest frame 2 during the tilting of the backrest frame 2. This was the feature of the previous invention P. In the treatment chair P, as apparent from the above referenced specification and description of the drawings thereof, a straight groove was used as a guide groove 11, with the result that the prior art chair P was found to have the following points to be improved. (Refer also to FIG. 2 which is an operating principle diagram illustrating the rise and fall movement of the backrest frame 2 of the chair in FIG. 1.) When the stroke of a piston rode 7 of a driving mechanism (hydraulic cylinder) is extended by a fixed length l, the locus of movement of the upper portion (for example, the uppermost end D of line $C_1$ running through the center of a pin B and the center of a roller 9) represents a measure (a segment of an arc) corresponding to the tilting speed of the backrest frame 2. In other words, when the pin B of the backrest frame 2 is moved from $B_1$ to $B_2$ and if the stroke of the piston rod 7 of the hydraulic cylinder 6 is extended by a fixed length l, point D is moved from $D_1$ to $D_2$ on an arc a of a circle with a pin 3 as the center and with a segment of line 3-B as a radius. Similarly, at other angles of the backrest frame 2, $B_3$-$B_4$ and $D_3$-$D_4$ are found.

It may now be seen when a comparison is made between arc segment $D_1$-$D_2$ and arc segment $D_3$-$D_4$, the former is longer than the latter. In other words, the speed (peripheral speed) at which the backrest frame 2 is moved while at a raised position is faster than that at which the frame 2 is moved while at a lowered position. This difference in speed produces a feeling of discomfort in the patient.

SUMMARY OF THE INVENTION

The present invention is directed to reducing the speed difference of the kind described as much as possible. In general terms it achieves that objective by providing the backrest frame with, instead of a completely straight guide groove, a guide groove including arcuate portion having a center side of curvature on the seat facing the frame.

A description will now be given of particular embodiments of the invention with reference to FIGS. 3 through 6 of the accompanying drawings.

DETAILED DESCRIPTION OF THE INVENTION

Figure 1:
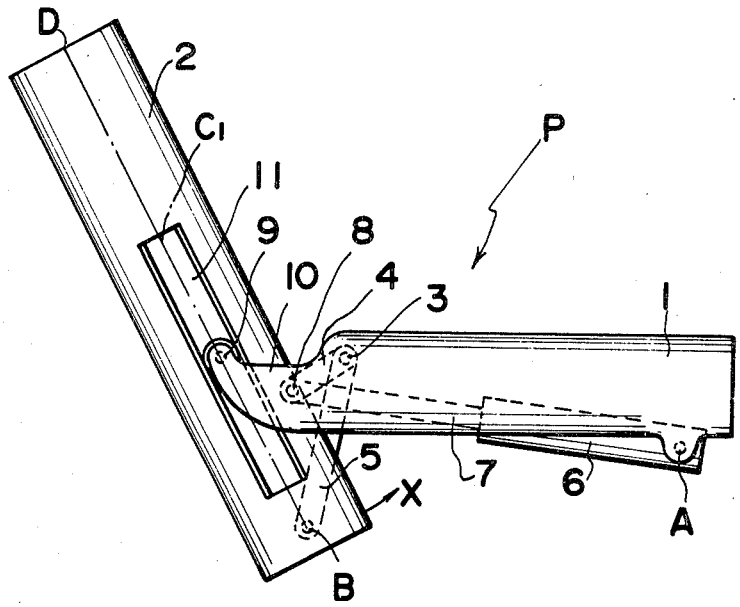
FIG.1 (Prior Art)
FIGS. 1 and 2 relate to the above described prior art treatment chair.
Figure 3:
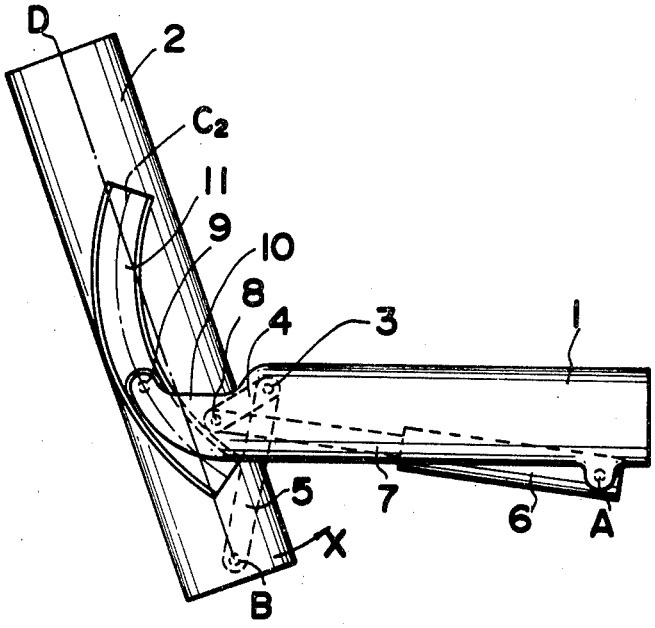
FIG. 3 shows an embodiment of the treatment chair according to the present invention.

A treatment chair in accordance with a preferred embodiment of the invention comprises a roller 9 supported at the end of a seat frame 1 of the treatment chair, a backrest frame 2 including a guide frame 11 adapted to the roller 9 therein, and a driving mechanism 6 supported by a pin in the seat frame, by which mechanism 6 the lower end of the backrest frame is designed to arcuately travel along a path lying below the place in which the backrest frame 2 rotates in contact with the roller 9. The chair is characterized in that the guide groove 11 includes an arcuate portion having at least a center of curvature at the side facing said seat frame 1 whereby the peripheral speed of the upper portion of the backrest frame 2 is substantially kept constant during the rise and fall of the frame 2. In FIG. 3 (likewise in FIG. 1), the numeral 3 designates a pin rotatably supported on a seat frame 1; 4 and 5 designate respectively a crank and a link each having a connecting point fixed to the pin 3. The angles of intersection of the crank 4 and the link 5 are kept invariable. A driving mechanism 6 is rotatably supported by a pin A fixed integrally to the seat frame 1. The mechanism 6, for example, may be a hydraulic cylinder whose piston rode 7 is supported by and connected rotatably to the crank 4 by a pin 8. The link 5 is rotatably supported by a pin B provided as a pivoting member for the link 5 in the lower part of the backrest frame 2. A roller 9 is supported by an extension integral with the chair seat frame 1. A guide 11 is rigidly mounted to the backrest frame 2 and loosely fits over the roller 9 so as to allow the roller to rotate and also to allow an edge portion of the groove 11 to move with respect thereto. From the above structured description, it is clear that the angle of inclination of the backrest 2 with respect to the chair seat frame 1 depends upon the relative position of the roller 9 with respect to the pin B. Since the roller 9 is mounted to an extension 10 integral with the seat frame 1 of the treatment chair, the roller 9 does not change in position with respect to the seat frame 1 and the backrest frame 2 changes in angle of inclination in accordance with the change in position of the pin B with respect to the seat frame 1.

Figure 4:
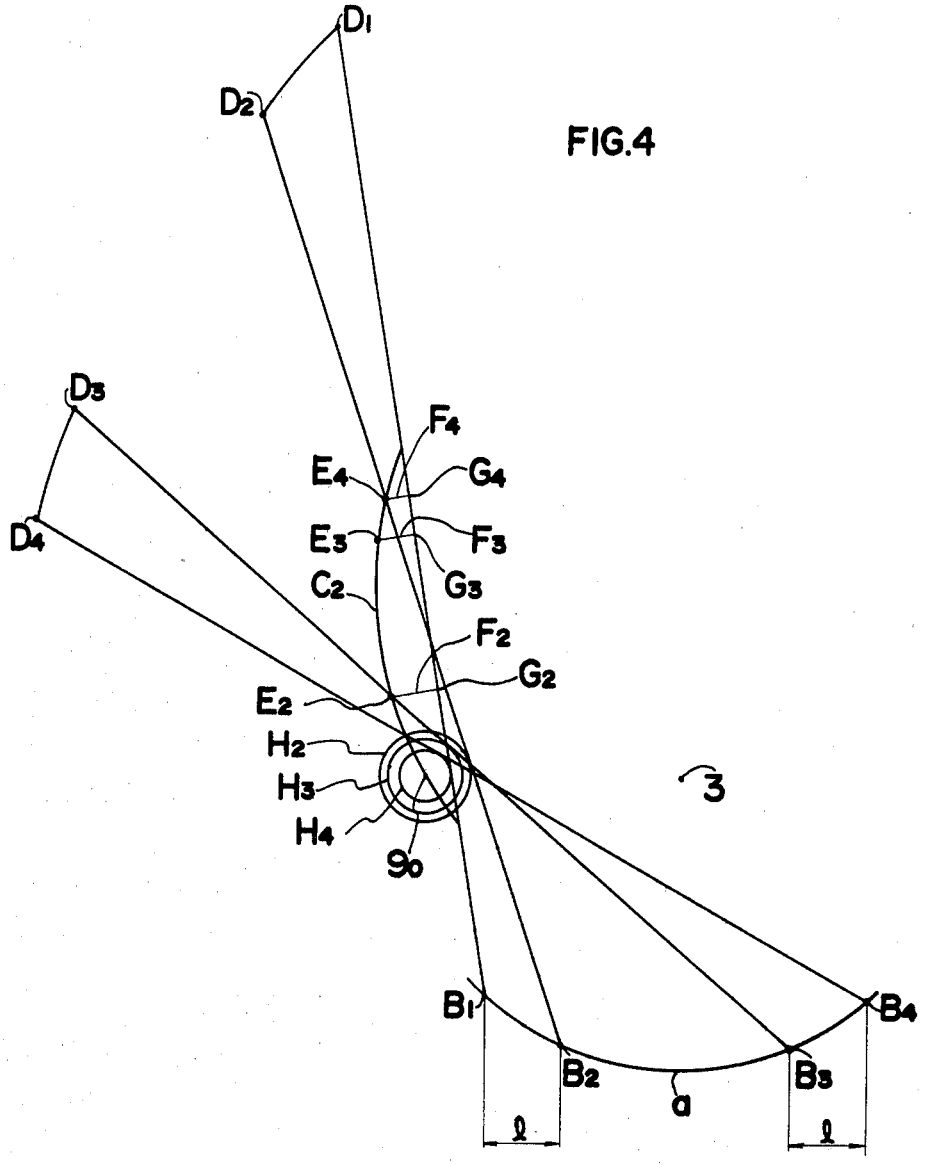
FIG. 4 is an operating principle diagram illustrating the rise and fall movement of the backrest frame of the chair in FIG. 3.

As shown in FIG. 4, the guide groove 11 in FIG. 3 has a center of radius of curvature on the side of backrest frame 2 facing seat frame 1, and is, in the illustrated embodiment, in the form of an arc of a true circle described by a single radius of curvature.

When the structure described above is operated so as to cause the piston rode 7 of the driving mechanism 6 to be drawn into the cylinder from the extended state shown in FIG. 3, the crank 4 is rotated counterclockwise around the pin 3. Since the crank 4 and the link 5 remain at a fixed angle of intersection with respect to each other, the link 5 also is rotated counterclockwise in accordance with the rotation of the crank 4, with the result that the pin B is rotated along at counterclockwise arc X around the pin 3, a line connecting the pin B with the roller 9 thus becoming tilted than at the start of the above-described.

On the other hand, when the tilted backrest 2 is raised to a less tilted position the link 5 is rotated clockwise by the piston rod 7 of the hydraulic cylinder 6 being pushed out of the cylinder, and as a result, the backrest frame 2 is raised. The chair of the present invention is the same as that of the previous invention P in that this lowering and raising is so as to prevent the patient from sliding on the backrest frame, but is different from the chair P in that the backrest frame 2 of the chair of the present invention moves with substantially the same peripheral speed throughout its range of travel as the frame 2 is raised and lowered.

Figure 2:
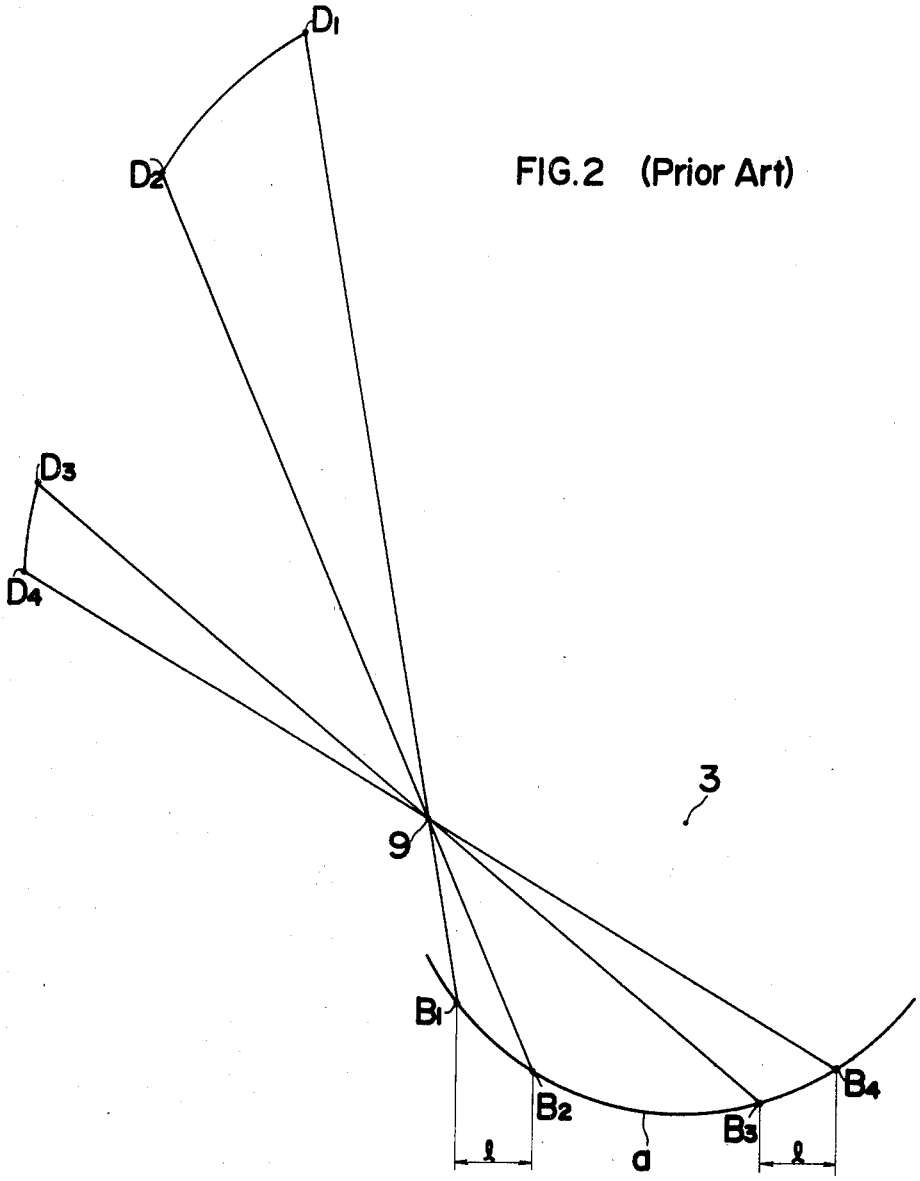
FIG.2 (Prior Art)

Referring to the operating principle diagram of FIG. 4, the moving distance l of the pin B is kept the same as the distance L in FIG. 2. In order to find $D_2$ corresponding to the position in which the pin B was moved from $B_1$ to $B_2$, a length $B_2$-$9_o$ from $B_2$ to the center $9_o$ of roller 9 is taken from $B_1$ of an arc $C_2$ of an arcuate groove 11 including the center $9_o$ and the point found on the arc $C_2$ is set as $E_2$, and a perpendicular $F_2$ is drawn from this $E_2$ line $B_1$-$D_1$ and a point of intersection of the perpendicular with the line is fixed as $G_2$. Next, a circle with line segment $E_2$-$G_2$ as a radius is concentrically described around the center $9_o$ to form a circle $H_2$. A tangent with respect to this circle $H_2$ is described from $B_2$ and the tangent is extended to a length equal to that of line $B_1$-$D_1$ to obtain $D_2$. Similarly, $D_3$ corresponds to $B_3$ and $D_4$ corresponding to $B_4$ are found and if $D_1$-$D_2$ and $D_3$-$D_4$ are connected respectively by approximate arcs, arc segments $D_1$-$D_2$ and $D_3$-$D_4$ are obtained. As will be apparent from comparison between $D_1$-$D_2$ and $D_3$-$D_4$ in FIG. 4, arc segment $D_3$-$D_4$ is substantially the same as arc segment $D_1$-$D_2$, and thus when compared with the case in FIG. 2, $D_3$-$D_4$ and $D_1$-$D_2$ are substantially maintained at a constant. The difference between the segment of arc $D_1$-$D_2$ and segment of arc $D_3$-$D_4$ can further be affected in point of design by the center of curvature and radius of arc C, the length of link 5, the position of $B_1$, positions of roller 9 and pin 3, etc. In each case, the described operating principle diagram is constructed by finding the relative position of roller 9 with respect to arcuate groove 11 at an arbitrary point during the arcuate movement of pin B and finding how the center line B-D of backrest frame 2 in the corresponding position changes its radius with respect to the center $9_o$ of roller 9. In the diagram, reference characters $E_3$, $E_4$, perpendicular lines $F_3$, $F_4$, points of intersection $G_3$, $G_4$, and circules $H_3$, $H_4$, are elements respectively correspnding to $E_2$, $F_2$, $G_2$ and $H_2$. Characters $E_1$, $F_1$, $G_1$, and $H_1$ are omitted from the diagram for clarity's sake.

Figure 5:
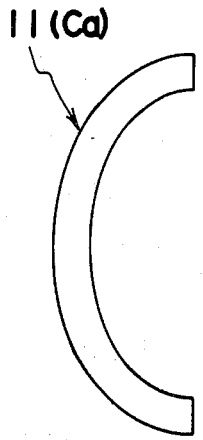
FIGS. 5 and 6 each show a guide groove of another embodiment of the present invention.
Figure 6:
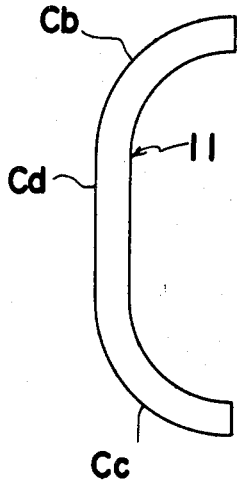

The description above has been given of the guide groove 11 with reference to an arcuate groove shown by way of illustration. As for other forms of the guide groove, it may be possible that the guide groove 11 is provided in the form of an arcuate groove $C_a$ of an oval with its greatest diameter oriented in the direction of the length of the guide groove 11 as shown in FIG. 5 or that the groove 11 is provide with the form of a guide groove made up, in combination, of arcs and a straght line in such a manner that, as shown in FIG. 6, the groove includes the same or approximate arcs $C_b$ and $C_c$ near the portions where the backrest frame 2 approaches its lowermost tilted position and uppermost raised position with respect to the chair seat 1, the arcs $C_b$ and $C_c$ being connected to each other by a straight line $C_d$. This is because there is little change in peripheral speed midway through the rise and fall of the backrest frame 2 and there is substantially little or no difference in peripheral speed between the straight guide groove and arcuate guide groove in the midway portion.

As explained above, the present invention accordingly makes it possible to maintain a relatively constant peripheral speed during the raising and lowering of the upper portion of the backrest frame by utilizing an arcuate groove in place of at least a portion of the straight guide groove in the prior art treatment chair P. Thus the invention accomplishes the important objective of further reducing the physical disorder and uncomfortable feeling of a patient.

I claim:

1. An improved chair of the type comprising (a) a seat frame, (b) a roller supported at the end of said seat frame, (c) a backrest frame, (d) a guide fixed in location with respect to said backrest frame adapted to rotatably fit said roller therein and (e) a driving mechanism connected to said seat frame and to said backrest frame for causing a point on the lower end of said backrest frame to arcuately travel along a path lying below the position in which said frame rotates in contact with said roller;

wherein the improvement comprises said guide groove comprising an arcuate portion having a center curvature on the front side of said backrest frame facing said seat frame and located so as to result in the peripheral speed of the upper portion of said backrest frame being maintained at a constant value during the raising and lowering of said backrest frame.

2. A treatment chair according to claim 1, wherein said guide groove arcuate portion is substantially in the shape of an arc segment of a true circle.

3. A treatment chair according to claim 1, wherein said guide groove is substantially in the shape of an arc segment of an oval.

4. A treatment chair according to claim 1, wherein the upper and lower portions of said guide groove are substantially in the shape of a circular arc segment and wherein said arc segments are connected by a straight line.

* * * * *